US010704400B2

(12) United States Patent
Sanzari et al.

(10) Patent No.: US 10,704,400 B2
(45) Date of Patent: Jul. 7, 2020

(54) ROTOR ASSEMBLY WITH ROTOR DISC LIP

(71) Applicant: PRATT & WHITNEY CANADA CORP., Longueuil (CA)

(72) Inventors: Lorenzo Sanzari, Montreal (CA); Sylvain Vignola, Saint-Basile-le-Grand (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 16/162,874

(22) Filed: Oct. 17, 2018

(65) Prior Publication Data

US 2020/0123912 A1 Apr. 23, 2020

(51) Int. Cl.

| | |
|---|---|
| ***F01D 5/30*** | (2006.01) |
| ***F01D 5/32*** | (2006.01) |
| ***F01D 5/08*** | (2006.01) |
| ***F01D 11/00*** | (2006.01) |
| ***F01D 1/02*** | (2006.01) |

(52) U.S. Cl.

CPC ..... *F01D 5/3007* (2013.01); *F01D 1/02* (2013.01); *F01D 5/081* (2013.01); *F01D 5/082* (2013.01); *F01D 5/085* (2013.01); *F01D 5/3015* (2013.01); *F01D 5/32* (2013.01); *F01D 5/323* (2013.01); *F01D 5/326* (2013.01); *F01D 11/00* (2013.01); *F01D 11/001* (2013.01); *F01D 11/006* (2013.01); *F01D 11/008* (2013.01); *F05D 2240/20* (2013.01); *F05D 2240/30* (2013.01); *F05D 2240/55* (2013.01)

(58) Field of Classification Search

CPC ..... F01D 5/081; F01D 5/082; F01D 5/085; F01D 5/3007; F01D 5/3015; F01D 5/32; F01D 5/323; F01D 5/326; F01D 1/02; F01D 11/00; F01D 11/001; F01D 11/006; F01D 11/008; F05D 2240/20; F05D 2240/30; F05D 2240/55

See application file for complete search history.

(56) References Cited

U.S. PATENT DOCUMENTS 4,730,983 A * 3/1988 Naudet ..... F01D 11/006 416/220 R 8,727,735 B2 5/2014 Lee et al.

(Continued)

*Primary Examiner* — Nathaniel E Wiehe
*Assistant Examiner* — Ryan C Clark
(74) *Attorney, Agent, or Firm* — Norton Rose Fulbright Canada LLP

(57) ABSTRACT

A rotor disc of a gas turbine rotor assembly is provided. The rotor disc may support a plurality of blades attached thereto. The rotor disc may have a plurality of fixing members defined therein through its peripheral surface and circumferentially spaced apart from one another. The fixing members may extend axially from a front end portion to a rear end portion of the disc. Profiled slots may be defined between pairs of adjacent ones of the fixing members and may be configured to receive complementary profiled blade root portions. A plurality of disc lips may project axially forward from a surrounding surface of the disc in the front end portion. A disc lip may be disposed at a tip portion of a fixing member, adjacent a leading edge of the disc to minimize air leakage at a disc/blade interface. A rotor assembly with such rotor disc and a plurality of blades attached thereto is also provided.

20 Claims, 5 Drawing Sheets

(56) References Cited

U.S. PATENT DOCUMENTS

| | | | | |
|---|---|---|---|---|
| 2002/0067987 | A1* | 6/2002 | Toborg | F01D 5/081 415/170.1 |
| 2010/0158686 | A1* | 6/2010 | Kim | F01D 5/22 416/1 |
| 2015/0204201 | A1* | 7/2015 | Turner | F01D 5/143 416/179 |
| 2017/0306771 | A1* | 10/2017 | Weinert | F01D 5/02 |
| 2018/0066528 | A1* | 3/2018 | Blanchard | F01D 5/3007 |

* cited by examiner

ROTOR ASSEMBLY WITH ROTOR DISC LIP

TECHNICAL FIELD

The application relates generally to rotors for a gas turbine engine, and more particularly to such rotors having blades removably mountable to a disc of the rotor.

BACKGROUND OF THE ART

Gas turbine engines generally include rotor assemblies such as compressor rotor(s) and turbine rotor(s). A rotor assembly usually includes one or more rows of circumferentially spaced rotor blades extending radially outwardly from a rotor disc and mounted thereto. During use, rotor assemblies are disposed within an air passage inside gas turbine engines and typically face an upstream pressurized and/or hot air/combustion gases flow. Air leakage passages may be observed at a disc/blade interface, notably at the upstream side of the rotor assemblies. Such air leakage passages may limit/reduce the performance and/or durability of rotor discs, seals and/or blades of such rotor assemblies. There is thus a need to alleviate at least partially this problem that may affect typical rotor assemblies.

SUMMARY

In one aspect, there is provided a rotor disc of a gas turbine rotor assembly for supporting a plurality of blades attached thereto, the rotor disc comprising: a front end portion and an opposite rear end portion axially spaced apart from one another, and a peripheral surface circumferentially extending about the disc between the front end portion and the rear end portion, a plurality of fixing members defined therein through the peripheral surface and circumferentially spaced apart from one another, the fixing members extending axially from the front end portion to the rear end portion of the disc, profiled slots defined between pairs of adjacent ones of the fixing members, the profiled slots configured to receive a complementary profiled blade root portion, and a plurality of disc lips projecting axially forward from a surrounding surface of the disc in the front end portion, a said disc lip disposed at a tip portion of a said fixing member, adjacent a leading edge of the peripheral surface of the disc.

In another aspect, there is provided a rotor assembly for a gas turbine engine, comprising: a plurality of blades having a blade root portion with a profiled shape, an airfoil portion and platform segments extending laterally from sides of the airfoil section into opposing relationship with corresponding platform segments of adjacent ones of the blades; and a rotor disc having a front end portion and an opposite rear end portion axially spaced apart from one another, and a peripheral surface circumferentially extending about the disc between the front end portion and the rear end portion, a plurality of fixing members defined therein through the peripheral surface and circumferentially spaced apart from one another, the fixing members extending axially from the front end portion to the rear end portion of the disc, profiled slots defined between pairs of adjacent ones of the fixing members and axially receiving a respective one of the blade root portions, a plurality of disc lips projecting axially forward from a surrounding surface of the disc in the front end portion, a said disc lip disposed at a tip portion of a said fixing member, adjacent a leading edge of the peripheral surface of the disc where the platform segments of adjacent ones of the blades and the disc lip interface.

DESCRIPTION OF THE DRAWINGS

Reference is now made to the accompanying figures in which.

DETAILED DESCRIPTION

Figure 1:
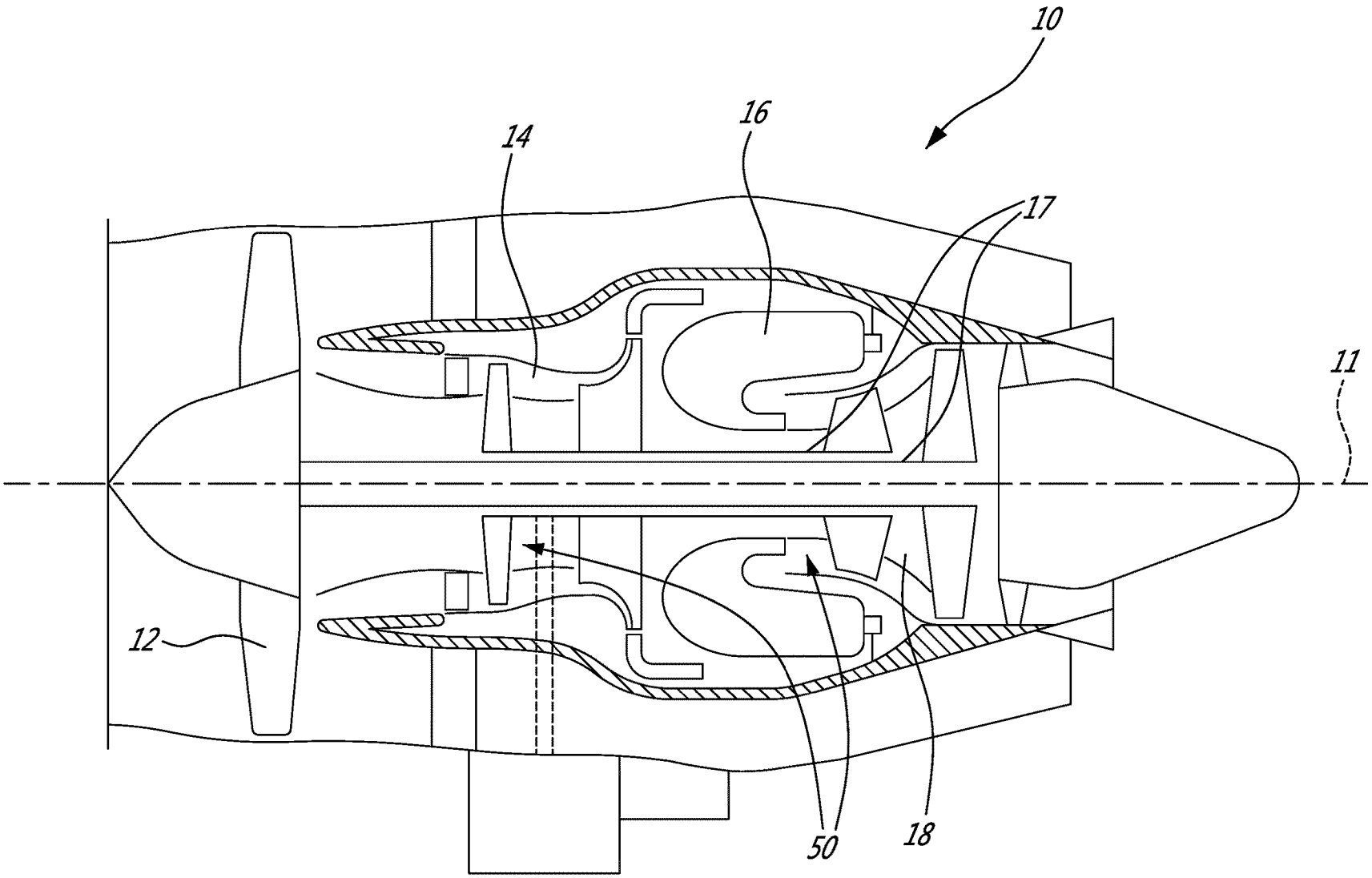
FIG. 1 is a schematic cross-sectional view of a gas turbine engine.
Figure 2:
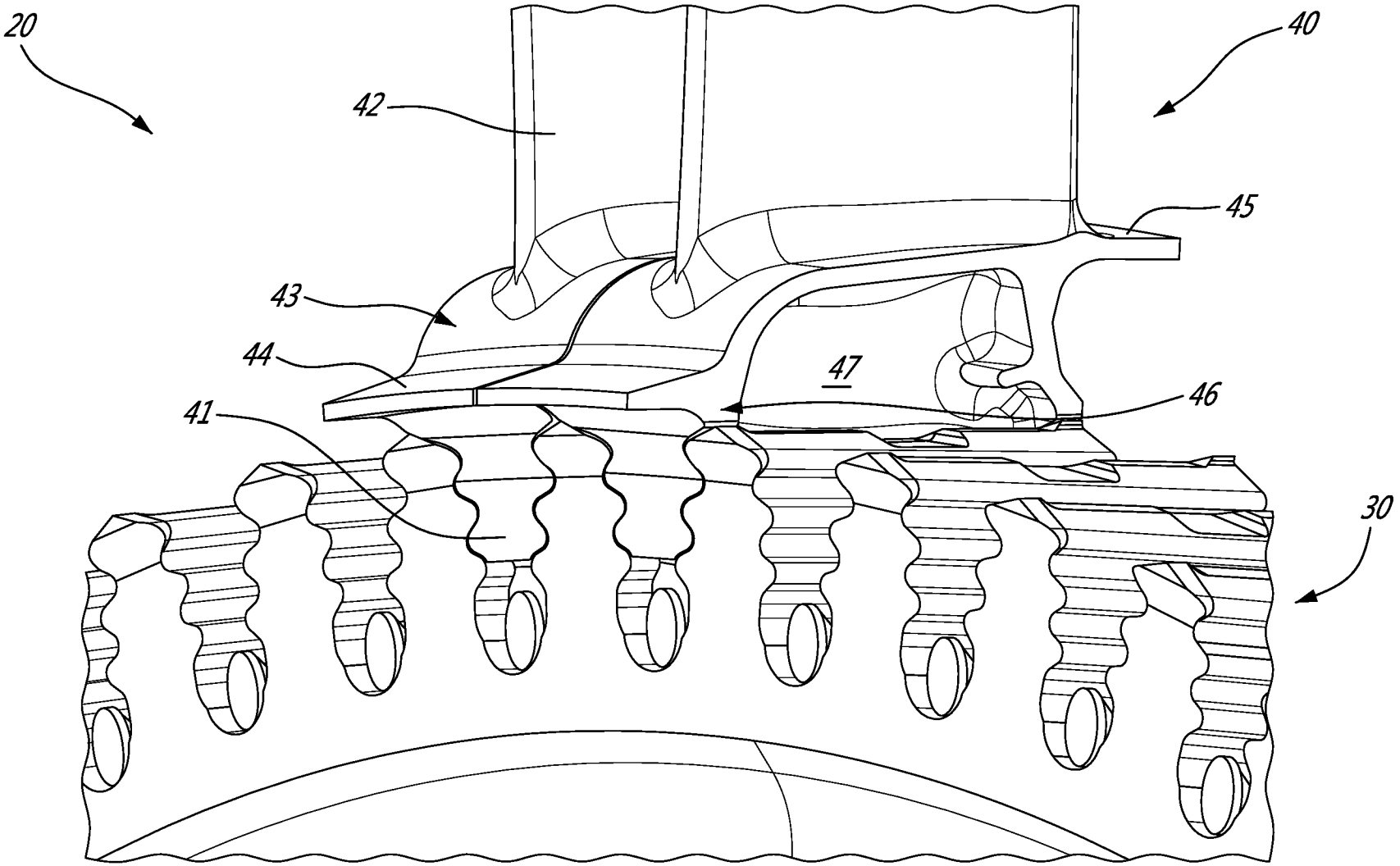
FIG. 2 is a fragmentary perspective view of a rotor assembly used in the gas turbine engine of FIG. 1, according to an embodiment.
Figure 3:
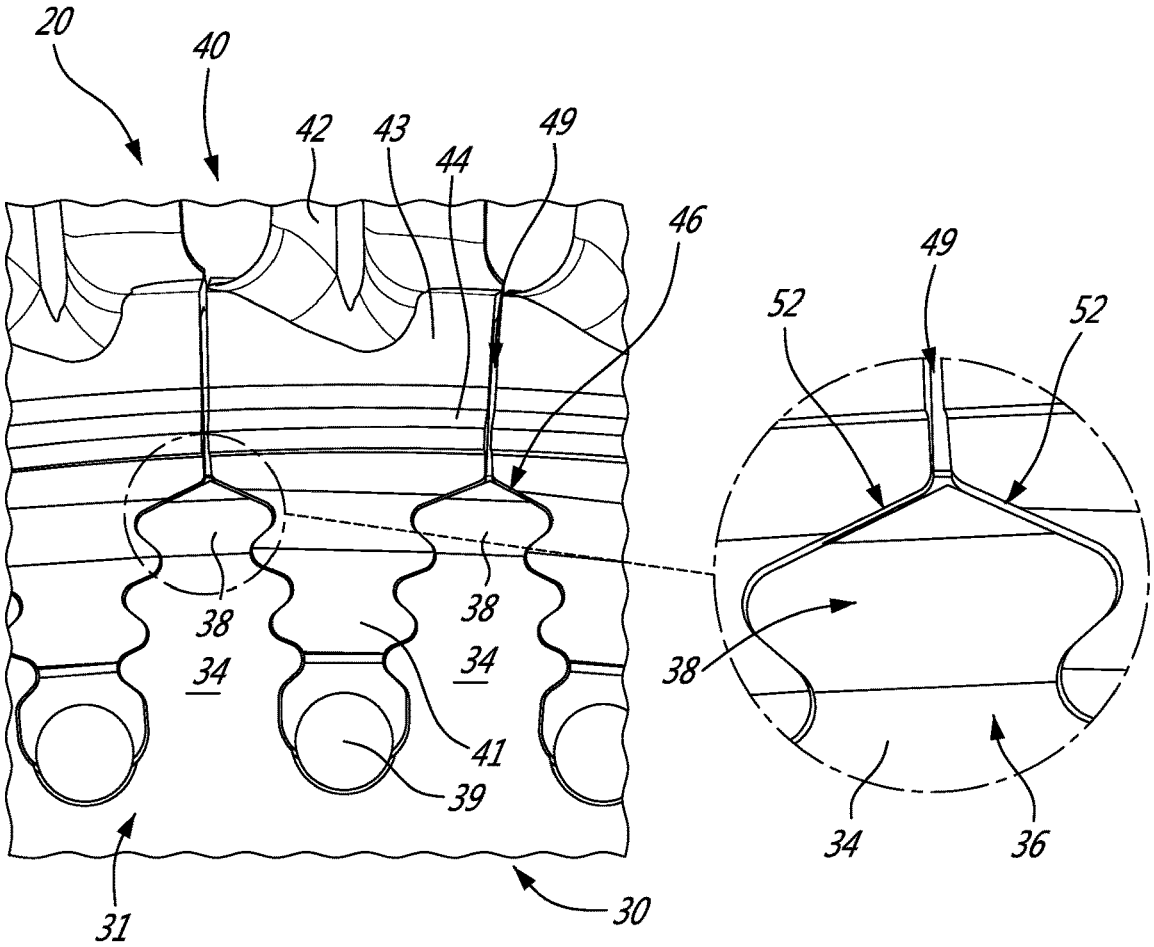
FIG. 3 is a fragmentary front view of the rotor assembly shown in FIG. 2, according to an embodiment.
Figure 4:
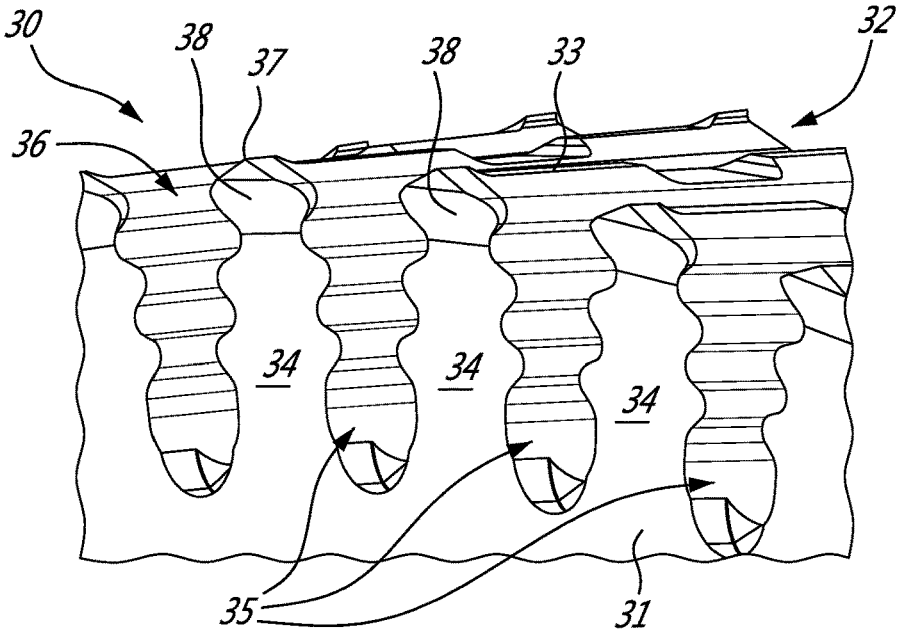
FIG. 4 is a fragmentary perspective view of the rotor disc shown in FIGS. 2 and 3, according to an embodiment.
Figure 5:
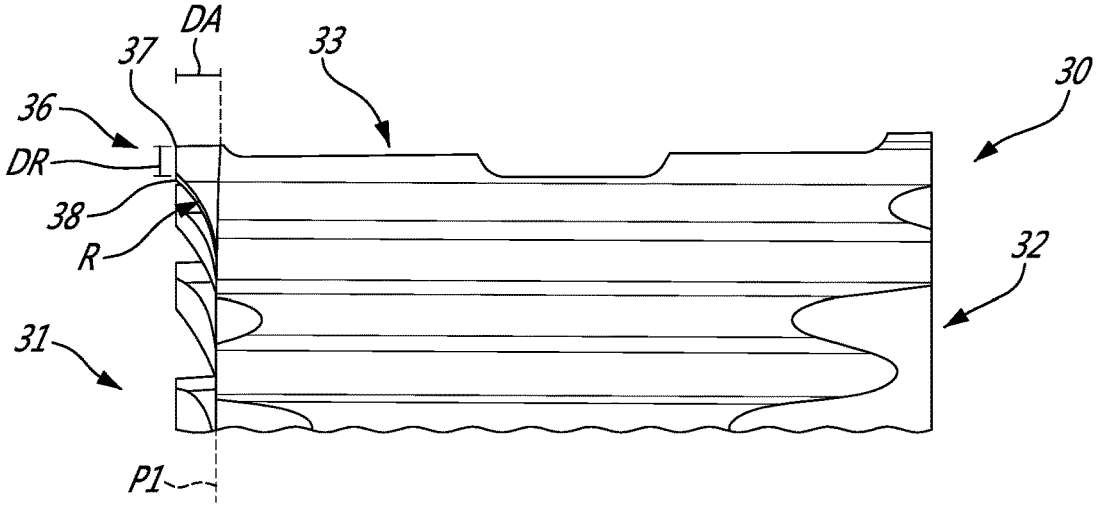
FIG. 5 is a fragmentary side view, partly cutaway, of the rotor disc shown in FIGS. 2 to 4, according to an embodiment.
Figure 6:
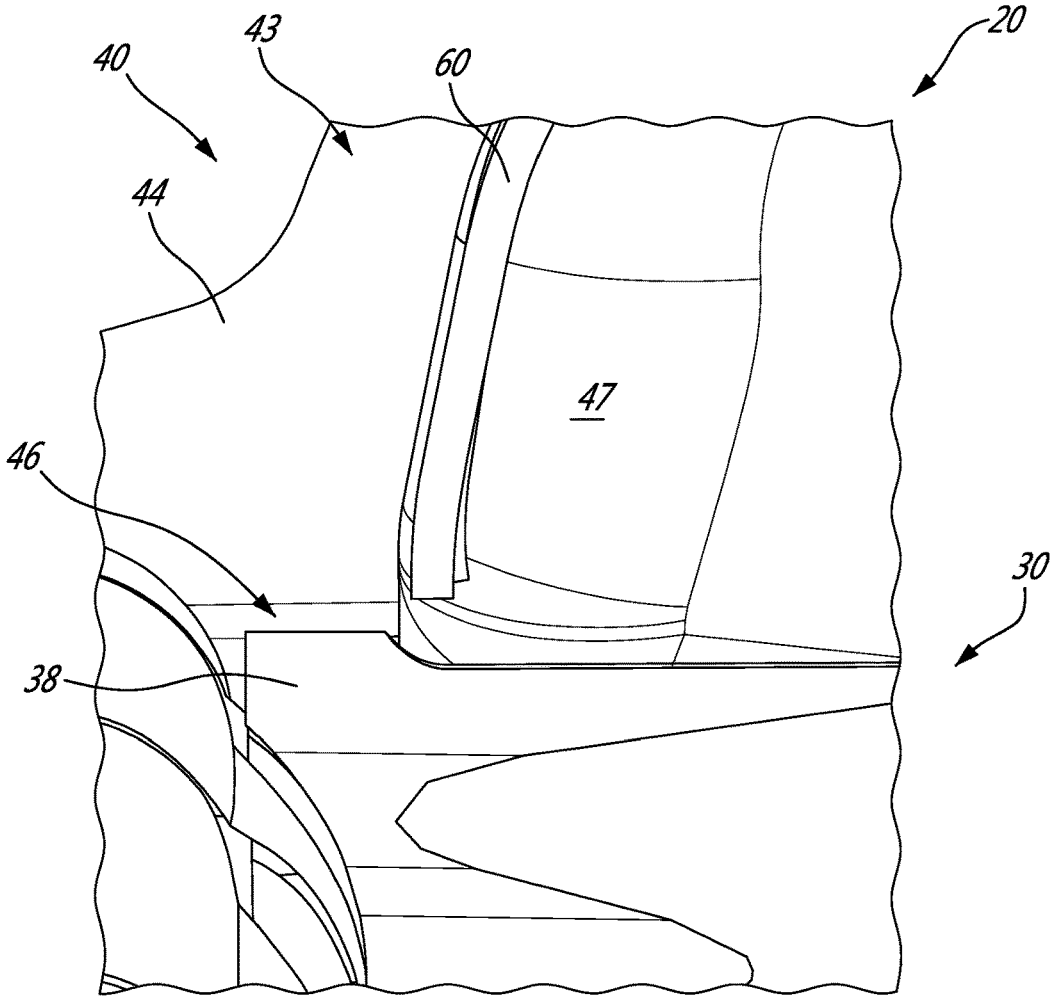
FIG. 6 is a fragmentary cutaway side view of the rotor assembly of FIGS. 2 and 3, showing a portion of a disc/blade interface, according to an embodiment.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. One or more shaft(s) 17 is/are in driving engagement with other rotating parts of the engine 10 in the compressor section 14 and the turbine section 18.

Referring to FIGS. 2 to 6, an embodiment of a rotor assembly 20 for the gas turbine engine 10 is partially shown. The rotor assembly 20 may be any suitable component of the compressor section 14 or turbine section 18 which includes a rotor disc 30 (partially shown) and rotor blades 40 surrounding and rotating with a shaft 17 along an axis 11 (FIG. 1) of the engine 10. In an embodiment, the rotor assembly 20 may form part of an axial compressor disposed in an air passage 50 of the compressor section 14. In another embodiment, the rotor assembly 20 may form part of an axial turbine disposed in a passage 50 of the combustion gases for extracting the energy from the combustion gases in the turbine section 18.

In embodiments where the rotor assembly 20 may be disposed downstream of the combustor 16 in the turbine section 18, the components of the rotor assembly 20 may have to sustain high pressures and temperatures during operation of the engine 10. Such operating conditions may affect the durability of said components. Hot combustion gases and/or air upstream of the rotor assembly 20 may infiltrate interstitial spaces between components connecting/interfacing together in the rotor assembly 20. Minimizing such air leakage passages at interfaces between components of the rotor assembly 20 may be desirable in order to limit (reduce) the rate at which these components heat up during normal operation of the engine 10 and/or so as not to limit the negative impacts of infiltration on the efficiency of the gas turbine engine 10. As discussed below, components of the rotor assembly 20 may be adapted to minimize air leakage passages at selected locations about the disc 30, more particularly at a disc/blades interface.

In an embodiment, the rotor assembly 20 comprises a rotor disc 30 and a plurality of rotor blades 40 disposed circumferentially about and connected to the rotor disc 30. The blades 40 may be disposed circumferentially about the disc 30 in more than one row implementing axial stages of the rotor assembly 20. These stages may correspond to compression stages or pressure stages in certain embodiments. The blades 40 may or may not be equally circumferentially spaced apart from one another about the disc 30, but they are typically equally spaced apart from one another.

The disc 30 has a front end portion 31, an opposite rear end portion 32 axially spaced apart therefrom, and a peripheral surface 33 circumferentially extending about the disc 30 between the front end portion 31 and the rear end portion 32. The front end portion 31 may define a front end surface and the rear end portion 32 may define a rear end surface of the disc 30 between which the peripheral surface 33 of the disc 30 may extend. In an embodiment, the end surfaces are substantially parallel relative to each other and substantially perpendicular relative to the axis 11 of the engine 10. The front end surface and/or the rear end surface may form flat plane portions, to which the axis 11 is normal when the rotor assembly 20 is installed in the engine 10. For example, either or both of the end surfaces may form flat annular portions, such as a flat peripheral ring or band, where the disc 30 connects to the blades 40. In an embodiment, the front end surface may be an upstream surface of the rotor assembly 20 relative to a direction of the flow path of combustion gases in the turbine section 18. In another embodiment, the rear end surface may be the upstream surface of the rotor assembly 20 in the compressor section 14. Thus, in the compressor section 14, a differential pressure of the air across the compressor rotor may act on the front surface of the disc 30, and in the turbine section 18, a differential pressure of the combustion gases across the turbine rotor may act on the front surface of the disc 30. In other words, a force derived from the differential pressure across the rotor assembly 20 acts on the front end surface during the normal operation of the gas turbine engine 10.

The disc 30 has a plurality of fixing members 34 defined therein through the peripheral surface 33 and circumferentially spaced apart from one another. The fixing members 34 may extend axially from the front end portion 31 to the rear end portion 32 of the disc 30. The fixing members 34 may be radial projections of the disc 30, with each fixing member 34 being substantially radial. The disc 30 includes a plurality of profiled slots 35 defined therein through the peripheral surface 33, between pairs of adjacent ones of the fixing members 34. In an embodiment, the slots 35 may extend generally axially. Therefore, the disc 30 may have an alternating sequence of fixing members 34 and slots 35. In an embodiment, the machining or like fabricating of the slots 35 results in the presence of the fixing members 34. As the fixing members 34 and the slots 35 are side by side, they have complementary shapes. In an embodiment, the slots 35 may extend axially from the front end surface to the rear end surface of the disc 30, in which a front slot opening and a rear slot opening may be respectively defined. In other embodiments, the slots 35 may not extend all the way through an axial width of the disc 30, as the slots 35 may have an axial dimension smaller than the axial width of the disc 30. Stated differently, the rear end surface of the disc 30 may not define a rear slot opening. In some embodiments, the slots 35 may be slightly skewed relative to a longitudinal axis of the rotor assembly 20. The slots 35 may be any suitable groove, opening and/or recess formed in the peripheral surface 33 of the disc 30 to receive a generally complementary portion of one of the blades 40, which may be a root portion of the blades 40 as discussed later, in order to thereby connect, secure and/or attach the blade 40 onto the disc 30.

In an embodiment, the fixing members 34 may have a profiled contour which may be, for example, formed by a series of lobes having decreasing circumferential widths from the radially outermost lobe ("top lobe"), to the radially innermost lobe ("bottom lobe"), with the radially central lobe ("mid lobe") disposed therebetween and having an intermediate lobe width. Such a multi-lobed profiled contour is typically referred to as a firtree, because of this characteristic shape. It is to be understood from the above that the slots 35 may have a complementary firtree shape, as in some embodiments side walls of the slots 35 may each define a respective side of the profiled contour of the fixing members 34. Whether or not in the shape of a firtree or lobes, the fixing members 34 and slots 35 define mechanical interferences that form abutments the prevent a radial outward movement of blades 40 connected to the disc 30.

Opposite sides of the profiled contour of the fixing members 34 may converge/taper at a tip portion 36 of each one of the fixing members 34 and may thereby define portions of a leading edge 37 of the peripheral surface 33 of the disc 30. Stated differently, an outer periphery of each fixing member 34, including its tip portion 36, may have a firtree shape. The fixing members 34 and slots 35 may have other profiled shapes in some embodiments.

Each blade 40 has a blade root portion 41, an airfoil portion 42 and a platform or platform segments 43 extending laterally from sides of the airfoil portion 42 into opposing relationship with corresponding platform segments 43 of adjacent ones of the blades 40. These portions of the blade 40 may all merge together to form a single piece blade 40, though a multi-piece configuration is also possible.

The blade root portion 41 of each blade 40 may be received in a corresponding slot 35 of the disc 30. The root portion 41 may have a shape and size that dovetail with the shape and size of the corresponding slot 35. The size of the blade root portions 41 may be slightly smaller than or equal to the size of the slots 35 to allow the blade root portions 41 to slide within the slots 35 when connecting the blades 40 to the disc 30. Once received in the slot 35, the blade root portion 41 may be secured therein with a retaining member 39. The retaining member 39 may be any fastening structure such as a retaining ring, a rivet connector or any other suitable types of retaining member that may connect the blade root portions 41 and axially block it in inside respective slots 35 to prevent axial movement between the blade root portions 41 and the slots 35.

The airfoil portion 42 of each blade 40 may extend generally or partially transversally to the direction of the flow path of air/combustion gases in the air/combustion gases passage 50. The airfoil portion 42 may have a profiled shape adapted to generate a pressure/velocity differential across the rotor assembly 20 (or a section thereof) when air/combustion gases flow across the airfoil portions 42 when the rotor assembly 20 rotates during operation of the engine 10.

Each platform segment 43 may have a curved profile forming a leading flange 44 protruding forwardly and a trailing flange 45 protruding rearwardly, and may include a shoulder portion 46 depending therefrom at a proximal end of the leading flange 44. The curved profile may define a platform recess 47 underneath each platform segment 43.

When the blades 40 are mounted on the disc 30, corresponding platform segments 43 of adjacent ones of the blades 40 may mate in opposing relationship, such that the platform recesses 47 under the corresponding platform segments 43 may together define a blade pocket 48, i.e., a global recess 48. Stated differently, the pocket 48 may be circumscribed by adjacent platform segments 43 of respective adjacent blades 40 and the peripheral surface 33 of the disc 30 when the blades 40 are mounted thereon. In some embodiments, the pocket 48 may contain a feather seal 60 that may seal a circumferential gap 49 (see FIG. 6) defined between side edges of adjacent platform segments 43. More particularly, such gap 49 may extend from the leading flange 44 to the trailing flange 45, along sides edges of adjacent platform segments 43. This seal 60 may contribute to minimizing air leakage between components of the rotor assembly 20, in this case adjacent blades 40 between their respective platform segments 43. Other interstitial spaces may exist elsewhere between adjacent components of the rotor assembly 20.

Minimizing air leakage passages 52 at the blade/disc interface may also be desirable in addition to or instead of minimizing air leakage along sides edges of adjacent platform segments 43, as discussed above, to reduce (limit or prevent) even more air/combustion gases ingested within the blade pocket 48. To this end, the disc 30 may include a plurality of disc lips 38 at the tip portion 36 of the fixing members 34. Each one of the fixing members 34 may have a respective disc lip 38. The disc lip 38 is located adjacent the leading edge 37 of the peripheral surface 33 of the disc 30. In an embodiment, the disc lip 38 may be an integral part of the disc 30 (i.e. an integral portion of each fixing member 34), but the disc lip 38 may also be a separate part added to the front portion 31 of the disc 30 in some embodiments. The disc lip 38 may reduce (e.g. minimize or prevent) an air leakage passage 52 at the disc/blade interface. Such leakage passages 52 are generally located where portions of the blades 40 interface with complementary portions of the disc 30 when the blades 40 are mounted thereon. More particularly, the leakage passages 52 may be located at an interface (i.e. where surfaces generally mate with one another) between rigid components. Typically, such passages 52 are minimal in size and may be due to manufacturing tolerances, although generally tight. As such, for assembling removably connectable components together, such as blades 40 onto the disc 30, the mating surfaces of complementary components, although complementary, may not perfectly conform (e.g. they may not contact over full surfaces) to one another. These manufacturing tolerances may also be present in consideration of thermal expansion/contraction of the components during operation of the engine 10. Although such passages 52 may impact the upstream disc seal efficiency, they may however allow such thermal expansion/contraction of components connected together and facilitate assembling the complementary components together. In some cases, the passages 52 may extend axially along the blade root portion 41, and be delimited by surfaces of the blade root portion 41 and of the side walls of the slot 35 receiving such blade root portion 41. More particularly, in some cases, a passage 52 may be defined at the tip portion 36 of a fixing member 34. There may be more than one passage 52, each at the tip portion 36 of a respective one of the fixing members 34, whether or not the fixing members 34 are all identical to one another. The passage 52 may axially surround the tip portion 36, where a radial dimension of the passage 52 may be maximal at an apex of the tip portion 36, an inlet of the passage 52 being at a location generally coinciding with the leading edge 37 of the peripheral surface 33 of the disc 30, the passage 52 extending along this apex toward the rear end portion 32 of the disc 30 between the tip portion 36 and overlapping mating surfaces of the platform segments 43 of adjacent blades 40.

The disc lip 38 may have many suitable shapes. For instance, in an embodiment, an outer periphery of the disc lip 38 may have the firtree shape of the fixing member 34, such that the outer periphery of the disc lip 38 may radially converge toward the peripheral surface 33 of the disc 30 and form the apex discussed above. The apex may be in line with a central radial axis of the fixing member 34. In an embodiment, the disc lip 38 may register (register or interface) with a complementary portion of two adjacent ones of the blades 40, (e.g. platform segments 43 of adjacent blades 40), where such portion may be the shoulder portions 46 of adjacent ones of the platform segments 43 of the blades 40. As such, the shape of the outer periphery of the disc lip 38 may correspond to that of respective shoulder portions 46 of the platform segments 43 of the blades 40. This may contribute to minimizing the air leakage passage 52 defined between the disc lip 38 and the shoulder portions 46. Also, in an embodiment, the disc lip 38 may have a frontal concavity, and may additionally have a frontal flat portion between the frontal concavity and the leading edge 37 of the peripheral surface 33 of the disc 30. Such concavity and flat portion of the disc lip 38 may conform to adjacent surfaces of the blade root portions 41 to allow evenness between the front end surface of the disc 30 and a frontal face of the blade root portions 41 when the blade root portions 41 are received within the slots 35 and secured therein. Such concavity and flat portion of the disc lip 38 may be differently shaped in some embodiments, where the front end surface of the disc 30 may be differently shape, particularly adjacent the tip portions 36 of the fixing members 34. In other words, the frontal face of the blade root portions 41 may generally conform to adjacent front surfaces of the disc 30. The disc lip 38 is a forward projection in the axial direction relative to the surrounding planar surface of the disc, such that the disc lip 38 projects forward the remainder of the disc 30. In other words, the surrounding surface of the disc may include an annular plane from which the disc lips 38 project axially forward. Stated differently, the front end surface of the disc 30 may be substantially planar or flat, lying in a plane to which the rotational axis is normal, at the location of the fixing members 34, with the exception of the disc lips 38, that project out of the plane. This is for example quite visible in FIG. 5, with the plane shown as P1. For instance, in a particular embodiment, the frontal concavity of the disc lip 38 may have a radius R of 0.125 inch±0.025 inch and an axial dimension DA of the disc lip 38 (i.e. distance over which the disc lip 38 forwardly project relative to the surrounding planar surface) from the frontal flat portion to the surrounding planar surface of the fixing members 34 is of 0.045 inch±0.015 inch. A radial dimension DR of the frontal flat portion of the disc lip 38 (i.e. dimension taken in a radial direction of the disc 30) may be of 0.045 inch±0.015 inch. In some cases, such axial and radial dimensions may be smaller or larger than the above dimensions in order to conform to the adjacent front surfaces of the blade root portions 41.

Figure 7A:
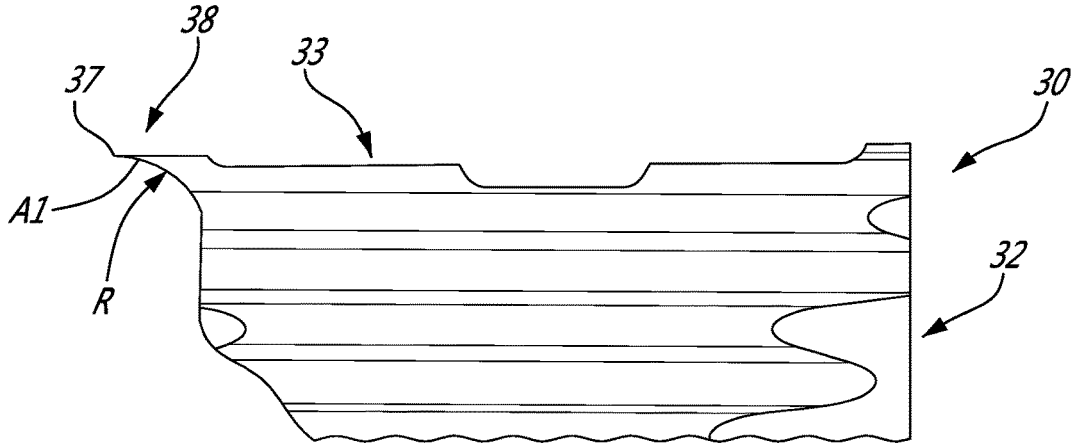
FIGS. 7A and 7B show examples of longitudinal cross-sections of a disc lip.
Figure 7B:
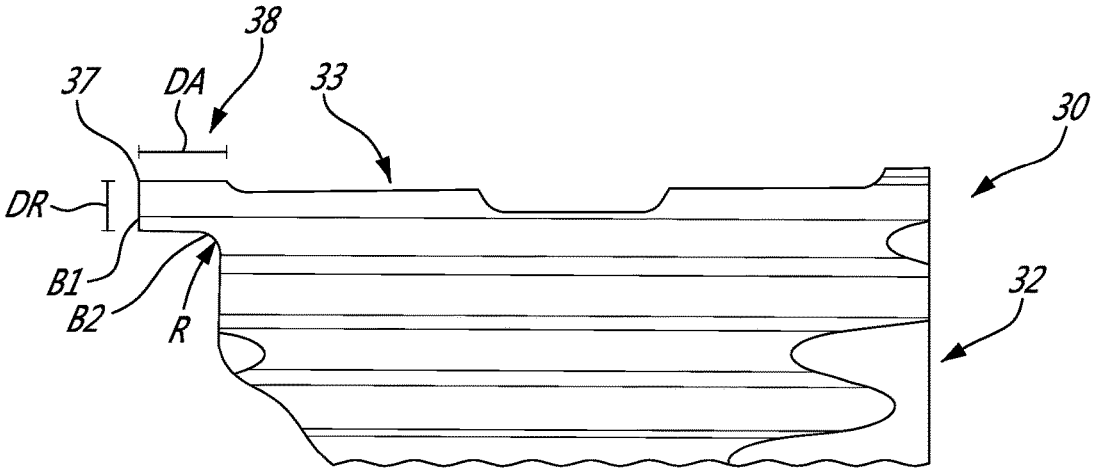

FIGS. 7A to 7B show variants of the shape of the disc lip 38. For example, FIG. 7A shows a longitudinal cross-section of the disc lip 38 according to an embodiment. As shown, the disc lip 38 may be a forward projection, similar as discussed above, but including a frontal concavity A1 transitioning from the substantially planar or flat front end surface of the disc 30 to the leading edge 37 without the frontal flat portion as discussed above. In other words, the disc lip 38 may be devoid of a frontal flat portion between the frontal concavity A1 and the leading edge 37 of the disc 30. This shape results in having a slender leading edge 37 of the disc 30 at the tip portion 36 of the fixing members 34. Stated differently, the forward projection defining the disc lip 38 is formed of a frontal concavity defining a pointed leading edge of the disc 30. The radius R of the frontal concavity A1 may range between 0.075 inch and 0.25 inch, and more particularly, in an embodiment, the radius R of the frontal concavity A1 may be 0.125 inch±0.025 inch.

FIG. 7B shows another variant of the longitudinal cross-section of the disc lip 38 according to another embodiment. As shown, the disc lip 38 may have a frontal flat portion B1 extending from the leading edge 37 toward an axial center of the disc 30, where the axial dimension DA of the disc lip 38 may range between 0.025 inch and 0.125 inch, and more particularly, in an embodiment, the axial dimension DA may be 0.0625 inch±0.025 inch. As shown in FIG. 7B, the radius R of the frontal concavity B2 may be smaller than 0.125 inch, and the radial dimension DR of the frontal flat portion may be 0.0625 inch±0.025 inch.

Figure 7C:
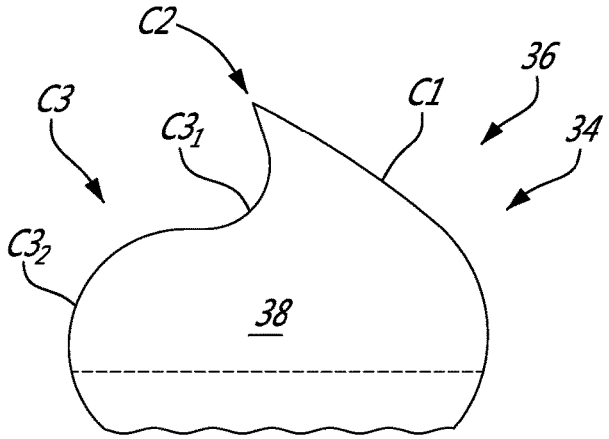
FIGS. 7C and 7D show examples of contours of a disc lip of a rotor disc, the contours viewed from the front of the disc lip.
Figure 7D:
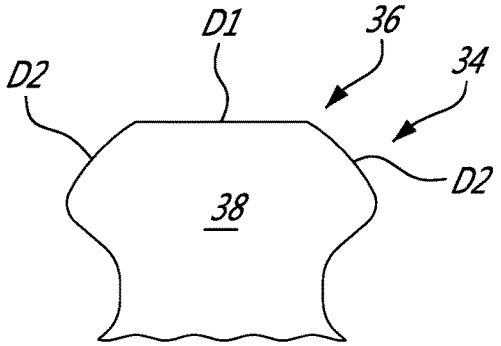

FIGS. 7C and 7D show yet other variants of the shape of the disc lip 38. For example, FIG. 7C shows a frontal contour of the disc lip 38 (i.e., the contour as seen from a frontal point of view) according to an embodiment, such frontal contour viewed transversally to the plane P1 discussed above. As shown, the disc lip 38 may be asymmetrical when viewed from upstream the disc 30. In other words, the frontal contour of the disc lip 38 may define a substantially flat portion C1 (e.g. substantially flat or slightly outwardly curved) that converges toward a blunted tip C2 angularly offset (i.e. skewed laterally) toward one side of the fixing members 34. The frontal contour of the disc lip 38 may also have, in addition to the blunted tip C2, a curved portion C3 defined by subsequent inward $C3_1$ and outward $C3_2$ radi extending from the blunted tip C2 and merging toward a lobed side of the fixing member 34.

FIG. 7D shows another variant of the frontal contour of the disc lip 38 according to another embodiment. As shown, the disc lip 38 may not define an apex (angularly offset or in line with a central radial axis of the fixing member 34). Rather, the tip portion 36 of the fixing member 34, including the disc lip 38, may define a flat top surface D1 between inwardly curved surfaces D2 that merge with opposite sides of the profiled contour of the fixing members 34.

Due to the presence of the disc lip 38 at the tip portion 36 of each fixing member 34 adjacent the leading edge 37, the axial width of the disc 30 from the front end surface to the rear end surface of the disc 30 widens at the tip portion 36 of each fixing member 34 toward the leading edge 37 of the peripheral surface 33 of the disc 30. Stated differently, such widening of the disc 30 towards the leading edge 37 and at the tip portion 36 of the fixing members 34 may define the disc lip 38 protruding forwardly from the remainder of the disc 30 (i.e. the disc lip 38 may protrude in an opposite direction relative to the air/combustion gases flow path). Although shown symmetrical on opposite sides of the central radial axis of the fixing member 34 in FIGS. 2 to 6, the frontal cross-section of the disc lips 38 and/or the fixing members 34 may be asymmetrical. In other words, the apex of the tip portion 36 may be angularly offset toward one side of the fixing members 34. In such case, the shape of respective shoulder portions 46 configured to mate with a corresponding disc lip 38 may be adapted to conform with the outer periphery of said asymmetrical disc lip 38. For instance, the shoulder portions 46 on each platform segments 43 of a blade 40 may thus not be identical in shape and/or size to accommodate to the complementary shape of the tip portion 36, more particularly the disc lip 38, of the fixing member 34 straddled therewith.

As indicated above, minimizing the air leakage passages 52 at the front of the disc 30 may be desirable in order to prevent air/combustion gases from flowing through air leakage passages 52 at the disc/blades interface. Consequently, such disc 30 with the disc lip 38 may have a lesser volume of air/combustion gases flowing through the disc/blade interface and reaching the pocket 48, over a disc 30 without such disc lip 38. This may incidentally enhance the upstream disc seal efficiency, reduce the overall engine specific fuel consumption, reduce the temperature increase of blades 40 and the disc 30 (more particularly, at the base of the blades 40 and at a periphery of the disc 30) during normal operation of the engine 10, and/or increase the durability of such components of the engine 10.

The above description is meant to be exemplary only, and one skilled in the art will recognize that changes may be made to the embodiments described without departing from the scope of the invention disclosed. Modifications which fall within the scope of the present invention will be apparent to those skilled in the art, in light of a review of this disclosure, and such modifications are intended to fall within the appended claims.

The invention claimed is:

1. A rotor disc of a gas turbine rotor assembly for supporting a plurality of blades attached thereto, the rotor disc comprising:

a front end portion and an opposite rear end portion axially spaced apart from one another, and a peripheral surface circumferentially extending about the disc between the front end portion and the rear end portion, a plurality of fixing members defined therein through the peripheral surface and circumferentially spaced apart from one another, the fixing members extending axially from the front end portion to the rear end portion of the disc, profiled slots defined between pairs of adjacent ones of the fixing members, the profiled slots configured to receive a complementary profiled blade root portion, and a plurality of disc lips projecting axially forward from a surrounding surface of the disc in the front end portion and an outer periphery of the plurality of disc lips extending radially outward from a surrounding portion of the peripheral surface of the disc, the plurality of disc lips disposed at respective tip portions of the plurality of fixing members, adjacent a leading edge of the peripheral surface of the disc.

2. The rotor disc as defined in claim 1, wherein an outer periphery of a respective one of the plurality of disc lips is configured to register with a complementary portion of two adjacent ones of the plurality of blades.

3. The rotor disc as defined in claim 1, wherein the front end portion and the rear end portion of the disc respectively define a front end surface and a rear end surface of the disc, an axial width of the disc from the front end surface to the rear end surface widens at the tip portion of each fixing member toward the leading edge of the peripheral surface of the disc, thereby defining the plurality of disc lips.

4. The rotor disc as defined in claim 1, wherein the surrounding surface of the disc includes an annular plane from which the plurality of disc lips project axially forward.

5. The rotor disc as defined in claim 1, wherein a respective one of the plurality of disc lips has a frontal concavity and a frontal flat portion between the frontal concavity and the leading edge of the peripheral surface of the disc.

6. The rotor disc as defined in claim 5, wherein the frontal concavity has a radius of 0.125 inch±0.025 inch and the frontal flat portion has a radial dimension of 0.045 inch±0.015 inch.

7. The rotor disc as defined in claim 5, wherein the fixing members have a firtree shape, the outer periphery of a respective one of the plurality of disc lips defines an apex radially converging toward the peripheral surface of the disc.

8. The rotor disc as defined in claim 7, wherein the apex is angularly offset toward one side of the fixing member.

9. The rotor disc as defined in claim 1, wherein each fixing member of the disc has a respective one of the plurality of disc lips.

10. A rotor assembly for a gas turbine engine, comprising:

a plurality of blades having a blade root portion with a profiled shape, an airfoil portion and platform segments extending laterally from sides of the airfoil section into opposing relationship with corresponding platform segments of adjacent ones of the blades; and a rotor disc having a front end portion and an opposite rear end portion axially spaced apart from one another, and a peripheral surface circumferentially extending about the disc between the front end portion and the rear end portion, a plurality of fixing members defined therein through the peripheral surface and circumferentially spaced apart from one another, the fixing members extending axially from the front end portion to the rear end portion of the disc, profiled slots defined between pairs of adjacent ones of the fixing members and axially receiving a respective one of the blade root portions, a plurality of disc lips projecting axially forward from a surrounding surface of the disc in the front end portion and an outer periphery of the plurality of disc lips extending radially outward from a surrounding portion of the peripheral surface of the disc, the plurality of disc lips disposed at respective tip portions of the Plurality of fixing members, adjacent a leading edge of the peripheral surface of the disc where the platform segments of adjacent ones of the blades and the plurality of disc lips interface.

11. The rotor assembly as defined in claim 10, wherein an outer periphery of a respective one of the plurality of disc lips is configured to register with a complementary portion of two adjacent ones of the plurality of blades.

12. The rotor assembly as defined in claim 10, wherein the front end portion and the rear end portion of the disc respectively define a front end surface and a rear end surface of the disc, an axial width of the disc from the front end surface to the rear end surface widens at the tip portion of each fixing member toward the leading edge of the peripheral surface of the disc, thereby defining the plurality of disc lips.

13. The rotor assembly as defined in claim 10, wherein the surrounding surface of the disc includes an annular plane from which the plurality of disc lips project axially forward.

14. The rotor assembly as defined in claim 10, wherein a respective one of the plurality of disc lips has a frontal concavity and a frontal flat portion between the frontal concavity and the leading edge of the peripheral surface of the disc.

15. The rotor assembly as defined in claim 14, wherein the frontal concavity has a radius of 0.125 inch±0.025 inch and the frontal flat portion has a radial dimension of 0.045 inch±0.015 inch.

16. The rotor assembly as defined in claim 14, wherein the frontal concavity and the frontal flat portion conform to adjacent surfaces of the blade root portions.

17. The rotor assembly as defined in claim 10, wherein the fixing members have a firtree shape, the outer periphery of a respective one of the plurality of disc lips defines an apex radially converging toward the peripheral surface of the disc.

18. The rotor assembly as defined in claim 10, wherein the platform segments include shoulder portions depending therefrom, a respective one of the plurality of disc lips interfacing with the shoulder portions of adjacent ones of the platform segments of the blades.

19. The rotor assembly as defined in claim 10, wherein a frontal face of the blade root portions generally conforms to adjacent front surfaces of the disc.

20. The rotor assembly as defined in claim 10, wherein each fixing member of the disc has a respective one of the plurality of disc lips.

* * * * *